US011234491B2

(12) United States Patent
Sweeney

(10) Patent No.: US 11,234,491 B2
(45) Date of Patent: Feb. 1, 2022

(54) SPIKE AND KEY SYSTEM AND METHOD

(71) Applicant: Orville R. Sweeney, Aurora, IL (US)

(72) Inventor: Orville R. Sweeney, Aurora, IL (US)

( * ) Notice: Subject to any disclaimer, the term of this patent is extended or adjusted under 35 U.S.C. 154(b) by 49 days.

(21) Appl. No.: 16/715,425

(22) Filed: Dec. 16, 2019

(65) Prior Publication Data

US 2020/0196710 A1 Jun. 25, 2020

Related U.S. Application Data

(60) Provisional application No. 62/782,568, filed on Dec. 20, 2018.

(51) Int. Cl.
*A43C 15/16* (2006.01)
*A43B 5/06* (2006.01)

(52) U.S. Cl.
CPC ..... *A43C 15/161* (2013.01); *A43C 15/165* (2013.01); *A43B 5/06* (2013.01)

(58) Field of Classification Search
CPC ..... A43B 5/06; A43C 15/161; A43C 15/165
See application file for complete search history.

(56) References Cited

U.S. PATENT DOCUMENTS

| | | | | | |
|---|---|---|---|---|---|
| 1,989,475 | A * | 1/1935 | Ehrmann | A43C 15/161 | 36/59 R |
| 2,509,980 | A * | 5/1950 | McCallum | A43C 15/161 | 36/62 |
| 5,655,317 | A * | 8/1997 | Grant | A43B 5/001 | 36/127 |
| 5,727,340 | A * | 3/1998 | Suk | A43B 5/001 | 36/127 |
| 6,101,746 | A * | 8/2000 | Evans | A43B 3/0042 | 36/128 |
| 6,182,379 | B1 * | 2/2001 | Savage | A43C 15/00 | 36/127 |
| 2014/0259764 | A1 * | 9/2014 | Schoenleber | A43D 999/00 | 36/65 |
| 2015/0189950 | A1 * | 7/2015 | Adams | A43C 15/005 | 36/59 R |

* cited by examiner

*Primary Examiner* — Ted Kavanaugh
(74) *Attorney, Agent, or Firm* — Husch Blackwell LLP

(57) ABSTRACT

A spike and key system is provided that includes a spike having a conical tip with a hole extending therethrough, and a key member including a first key having a racetrack shaped opening, and a second key having a rotatable key member designed to interact with the hole in the spike.

7 Claims, 9 Drawing Sheets

SPIKE AND KEY SYSTEM AND METHOD

BACKGROUND

Individuals that participate in various sports and activities utilize shoes having cleats or spikes worn on the feet of the individual to help the individual retain stability and balance on different types of surfaces. For example, cleats are used in several sports, including, but not limited to, soccer, football, lacrosse and the like. Cleats generally protrude from a bottom surface/sole of a shoe and are designed to at least partially extend into the ground or surface when the shoe contacts the surface. The interaction between the cleat and surface provides a gripping interaction, which provides stability to the wearer.

In the case of track and field events, cross-country events, and other sports, this same purpose is served by metal spikes which are typically screwed into the bottom surface/sole of the shoe. As a result, track and field shoes, and cross-country event shoes, are commonly referred to as 'spikes" owing to this feature.

In some sports, cleats may be provided as an integral part of the athlete's shoe and are not designed to be removed from the shoe. In this scenario, the cleats may be molded and made from a substantially similar material as the sole of the shoe. In other instances, the cleats may be provided in a different material with respect to the sole of the shoe, but are still integrally attached to the shoe and are not designed to be removed.

In other instances, (e.g., track and field or cross-country events) spikes associated with the shoe are designed to be exchanged, replaced, and/or removed from the shoe. For example, an athlete may be running on a softer surface, such as a dirt trail or grass, where a longer spike may be helpful, so the athlete could remove the standard spikes that came with the shoe and replace them with longer or shorter spikes as needed depending on the nature of the running surface. In addition, over time, spikes become worn because of ordinary wear and tear. Therefore, there are various scenarios where it would be desirable for an individual to have the flexibility to replace one or more spikes in their shoes.

A substantial amount of time is consumed by those wishing to replace the spikes using methods known in the prior art. In particular, prior art spikes are typically provided as a substantially unitary piece that include a thread that is designed to be screwed into a corresponding threaded hole in the bottom of the shoe. In this case, the user may hand thread the spike into the bottom of a shoe or use a specially designed spike key that features a hole designed to be placed onto, or fitted over, the spike. The prior art key then interacts with the spike and may be manually rotated in a clockwise direction to secure the spike onto the bottom of the shoe, or in a counter-clockwise direction to remove the spike from the bottom of the shoe. This process is repeated numerous times until all spikes are either secured to, or removed from, the shoe. The process is also repeated, and the prior art spike key is utilized in the removal of the spikes when the user desires to change the spikes.

Due to ordinary wear and tear of prior art spikes from repeated use over time, and due to ordinary wear and tear from repeatedly installing/removing the prior art spikes, both the prior art spikes and prior art spike key become stripped or worn to such a degree that the spike key will not fit properly over the spikes. This often makes it difficult for prior art spikes to be installed or removed at all. In these instances, athletes or coaches may use grip plyers or other inconvenient and time-consuming measures to remove spikes from shoes. In extreme instances, a spike may be cut (using a saw or other device) if the spike cannot be removed from the shoe. This scenario can be especially stressful to athletes preparing for a race about to begin when they are unable to remove worn spikes.

For the above instances, it would be desirable to have a spike and key system that allows for easy installation and removal and that overcomes one or more of the aforementioned obstacles.

SUMMARY

A spike and key system is provided that includes a spike having a conical body with a hole extending therethrough, and a key member including a first key having a racetrack shaped opening, and a second key having a rotatable key member designed to interact with the hole in the cleat.

DETAILED DESCRIPTION

Figure 1:
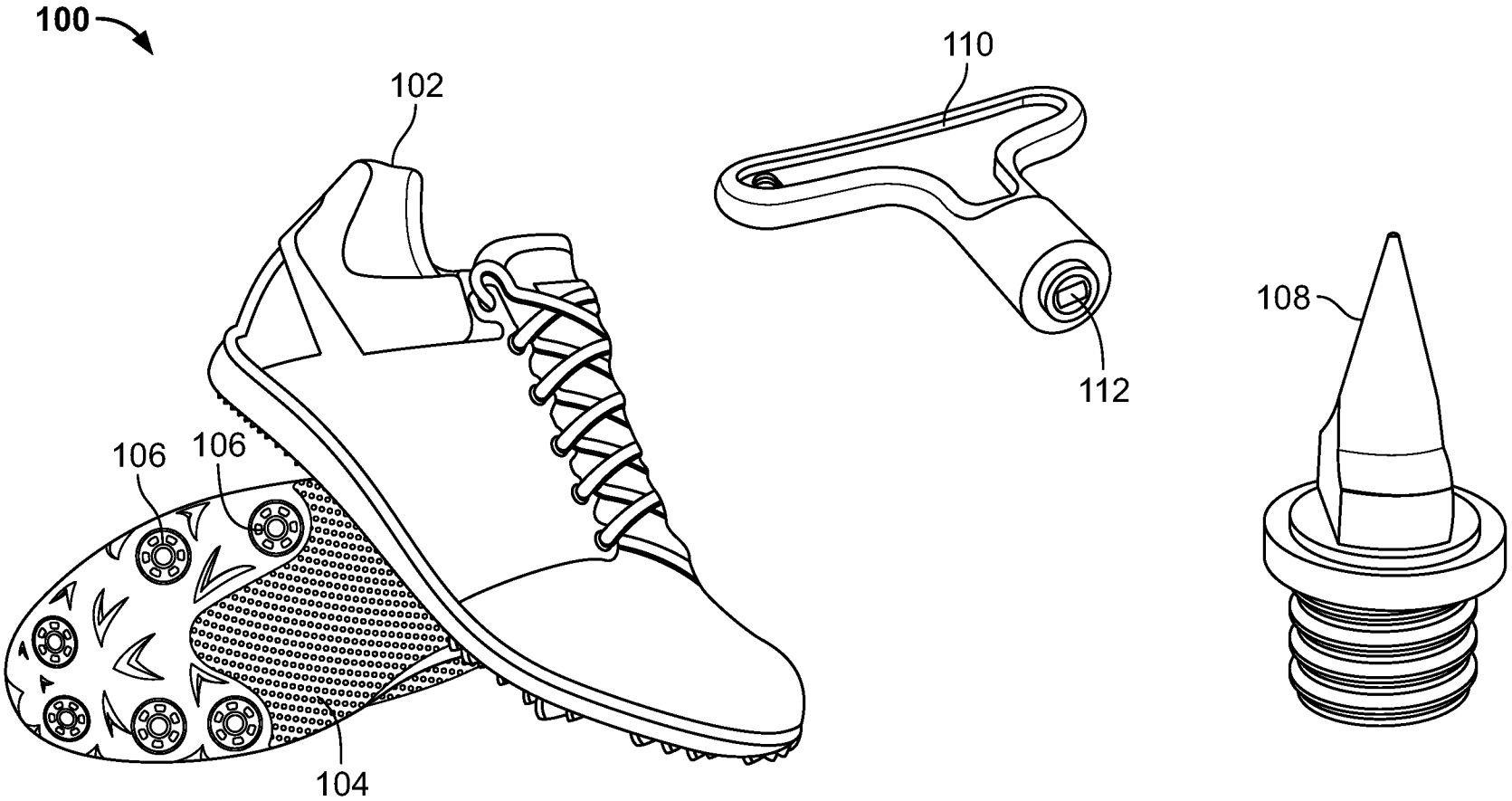
FIG. 1 (Prior Art)
FIG. 1 is a bottom isometric view of a traditional shoe, and a spike and key system according to the prior art.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates a traditional spike and key system 100 according to the prior art. The system 100 can include a shoe 102 having a bottom surface/sole 104. The sole 104 includes a plurality of cylindrical openings 106 that are designed to receive a plurality of removable spikes 108. A spike key 110 is provided that is designed to interact with each of the plurality of removable spikes 108 so that the spikes 108 may be installed or removed from the shoe 102. The key 110 includes a racetrack shaped opening 112 that corresponds to the profile of the spikes 108. To install or remove each of the spikes 108, the opening 112 of the key 110 is placed over the spike 108, and the key 110 is turned in a clockwise direction to install the spikes 108 and a counterclockwise direction to remove the spikes 108.

Figure 2:
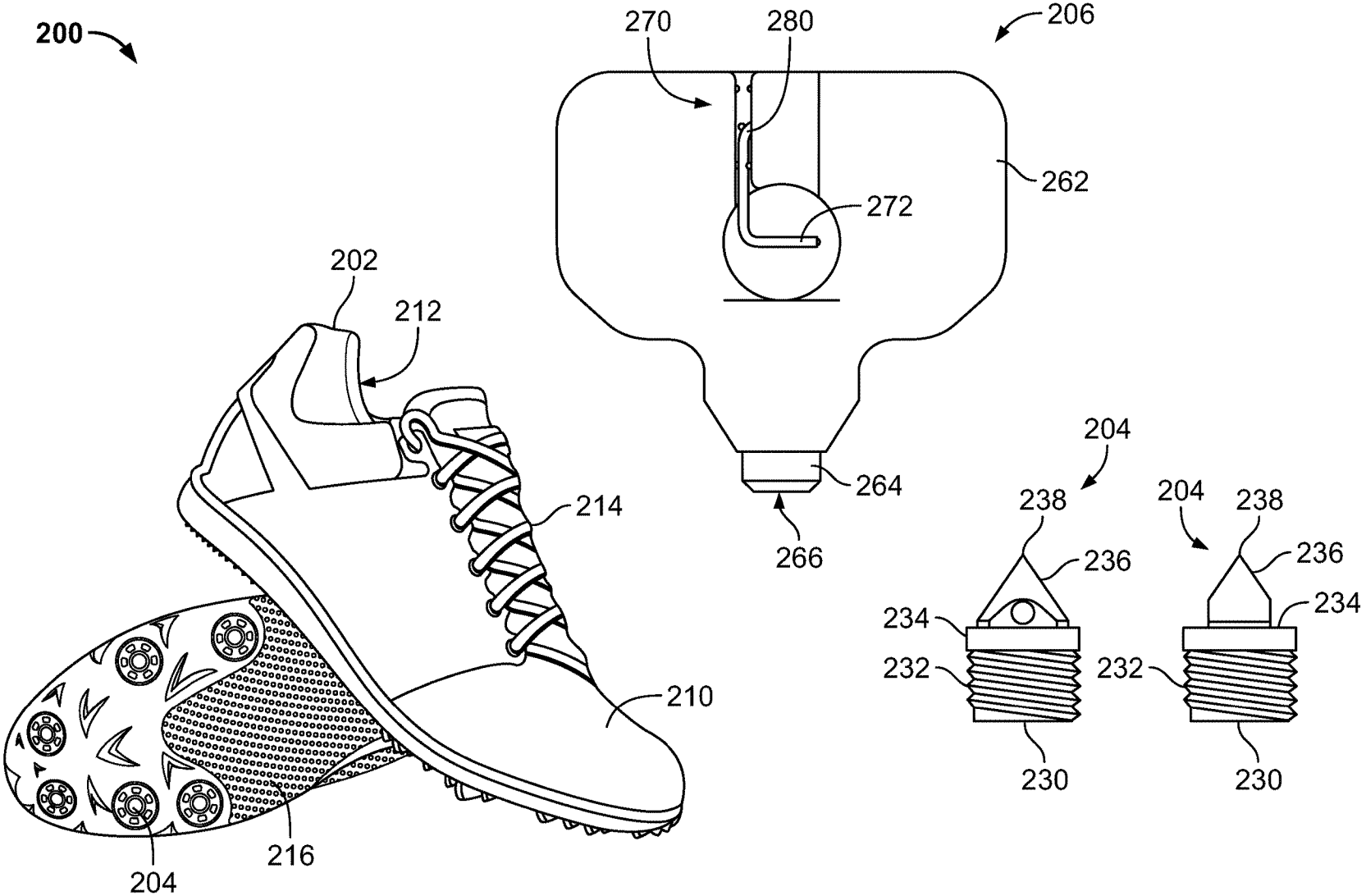
FIG. 2 is an isometric view of a shoe, and a spike and key system according to one embodiment.

FIG. 2 depicts a shoe and a spike and key system 200 according to one embodiment. The shoe, and spike and key system 200 includes one or more of a shoe 202, a plurality of spikes 204, and a key 206. The shoe 202, spike(s) 204, and/or key 206 may be provided as individual components or may be provided as a kit. For example, the spikes 204 and the key 206 may be provided as a kit and may act as a retrofitting kit, whereby the spikes 204 and the key 206 can be utilized with a shoe 202 that is already owned by an individual. In other examples, the spikes 204 and the key 206 may be provided with a pair of shoes 202 that a user may purchase. In further examples, the spikes 204 and/or key 206 may be provided individually.

Figure 3:
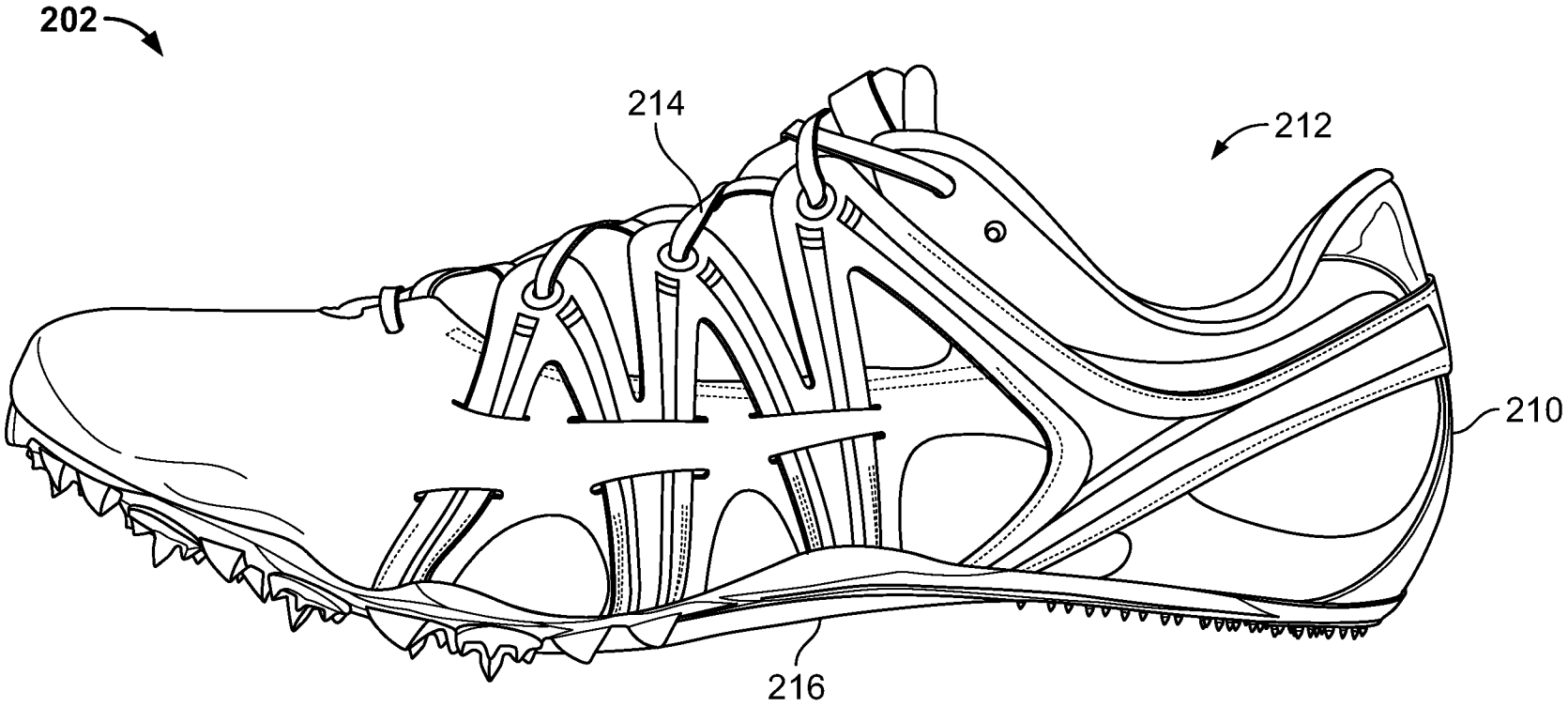
FIG. 3 is a side elevational view of a shoe with a plurality of spikes extending downwardly from a bottom surface thereof.
Figure 4:
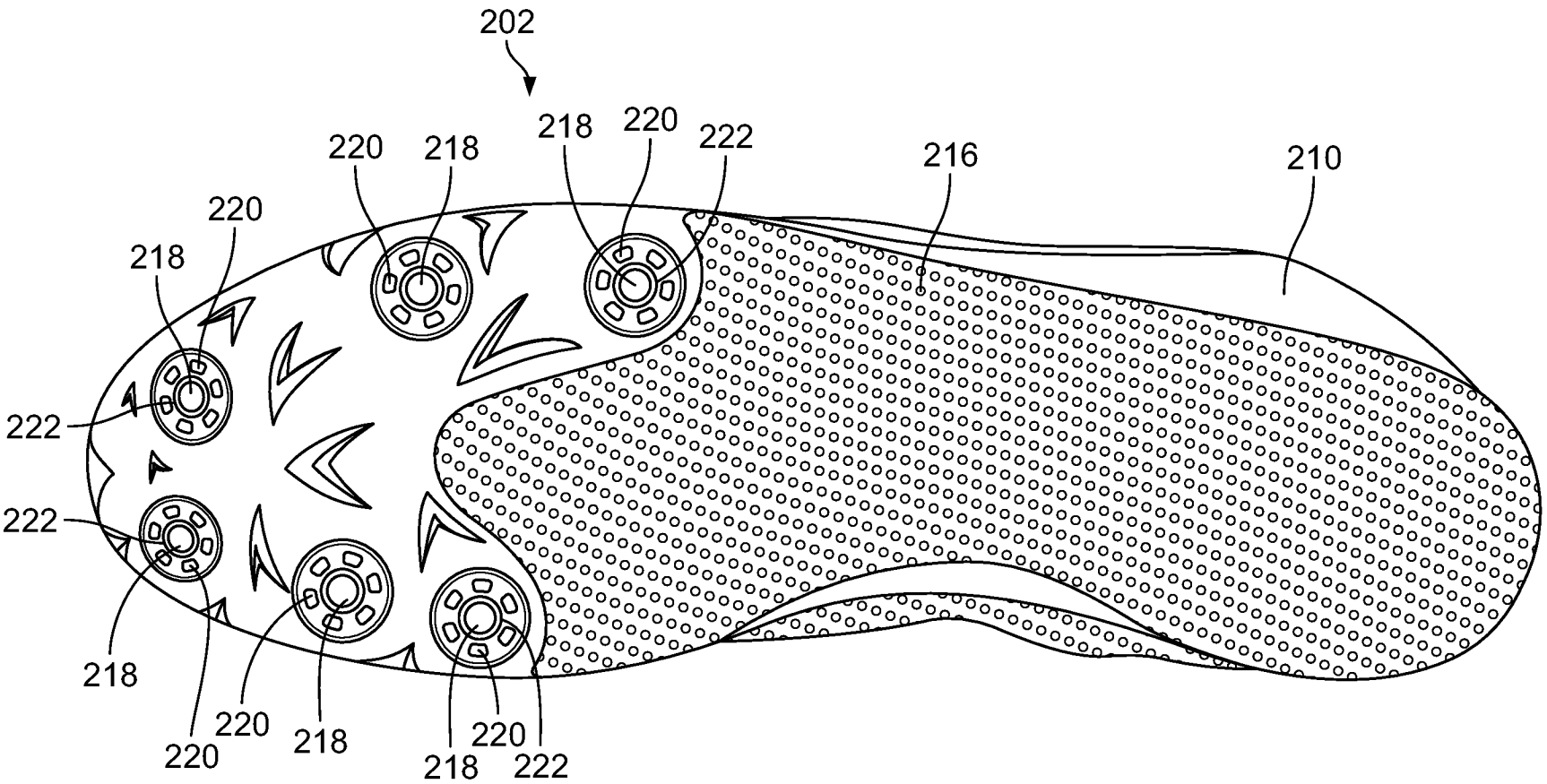
FIG. 4 is a bottom elevational view of the shoe of FIG. 3, with the plurality of spikes removed therefrom.

As shown in FIGS. 3 and 4, the shoe 202 includes a body 210 with an opening 212 designed to receive a foot (not shown). The shoe 202 may further include laces 214 or another securement mechanism that is designed to help retain the shoe 202 on a user's foot. The shoe 202 further includes a sole 216 positioned on the underside (e.g., bottom surface) of the body 210. The sole 216 includes a plurality of cylindrical bores 218 (see FIG. 4) that are designed to receive the spikes 204. The bores 218 may be positioned at various locations on the sole 216 and, in one instance, may be positioned in a front half of the body 210 of the shoe 202. In other embodiments, the bores 218 may be positioned at other locations on the sole 216 including, for example, in a rear half of the body 210 of the shoe 202, or covering the substantial entirety of the bottom surface of the shoe 202. The bores 218 may optionally include a raised surface 220 that circumscribes openings 222 defined by the bores 218. The bores 218 further include threads (not shown) on an interior surface thereof. The threads are designed to releasably interact with corresponding threads on the spikes 204, as will be described in more detail below.

The sole 216 of the shoe 202 may be provided in any material including, for example, rubber, polymer, and/or other combinations of natural or synthetic materials. At least a portion of the bores 218, including the interior surface, may be provided as a metal.

Figure 5B:
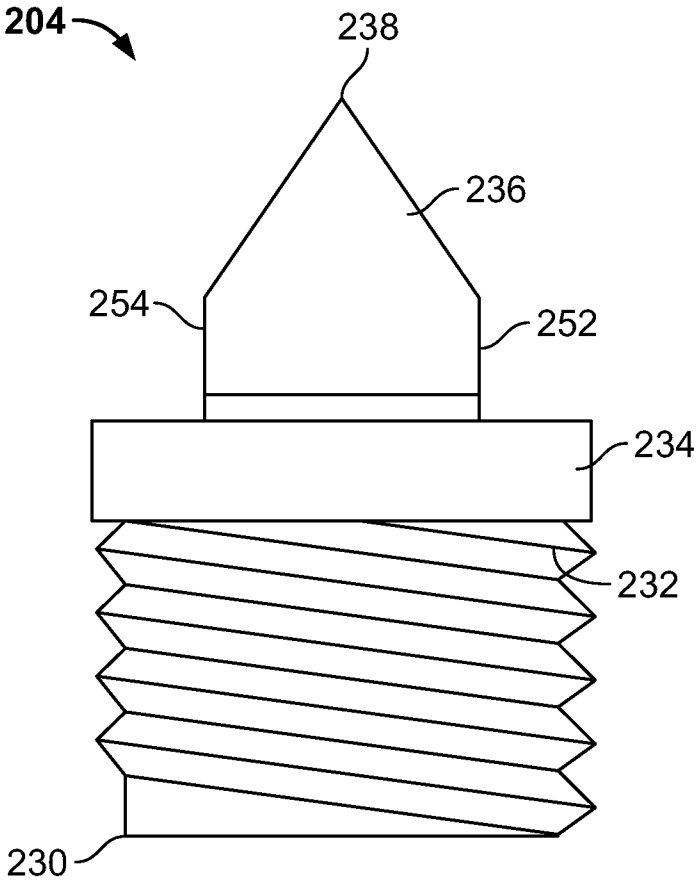
FIG. 5B is a side elevational view of the spike of FIG. 5A.
Figure 5A:
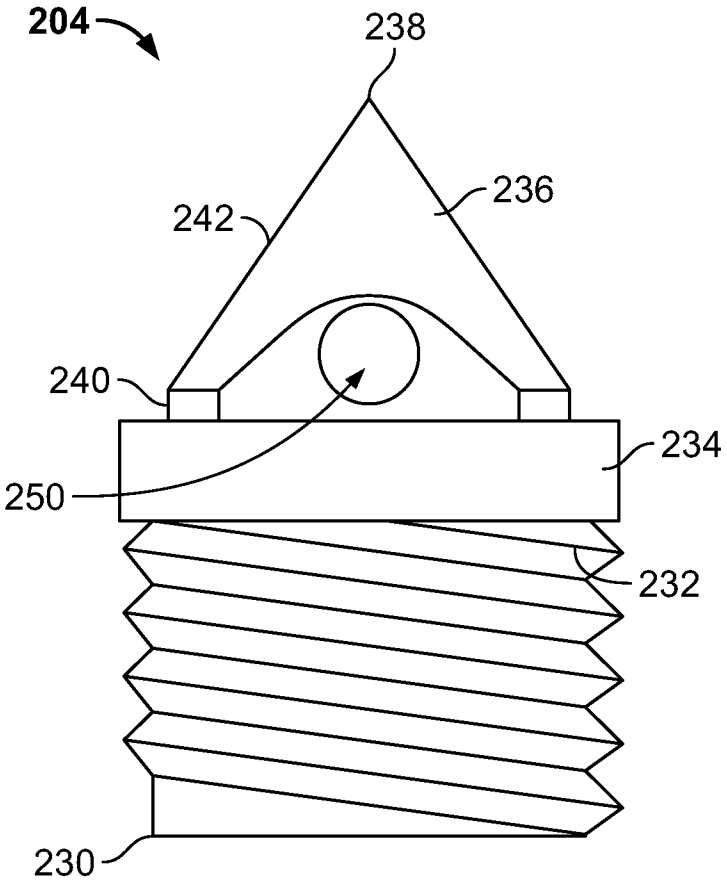
FIG. 5A is a front elevational view of a spike.

FIGS. 5A and 5B depict one embodiment of a spike 204. The spike 204 includes a cylindrical base 230 having threads 232 that circumscribe an exterior surface of the base 230. The threads 232 terminate at a disc member 234 that protrudes outwardly from the base 230. A tapered spike body 236 extends upwardly from the disc member 234 and terminates at a point 238. The spike body 236 includes a lower portion 240 having a substantially rectangular cross-sectional profile and an upper conical portion 242. A hole 250 extends through the lower portion 240 of the spike body 236. In some embodiments, the hole 250 is circular or cylindrical. In other embodiments, the hole 250 may be provided in other shapes/sizes including, for example, triangular, hexagonal, square, and the like. In one embodiment, the hole 250 extends entirely through the lower portion 240 of the spike body 236 from a first surface 252 to a second surface 254. In another embodiment, the hole 250 may extend only partially through the lower portion 240. The hole 250 is designed to extend through the lower portion 240 of the spike 204 as opposed to the spike body 236 or base 230. Although the hole 250 is depicted extending through the spike 204 along a lateral axis, the hole 250 could be provided along a longitudinal axis.

The spikes 204 may be provided in groups or may be provided as a single unit. Additionally, the spikes 204 may be provided in various lengths including, for example, 1/16 inch, 1/8 inch, 1/4 inch, 1/2 inch, 3/4 inch, 1 inch, and the like. The spikes 204 also may be provided as a metal (e.g., steel), a polymer, or another suitable material.

Figure 6:
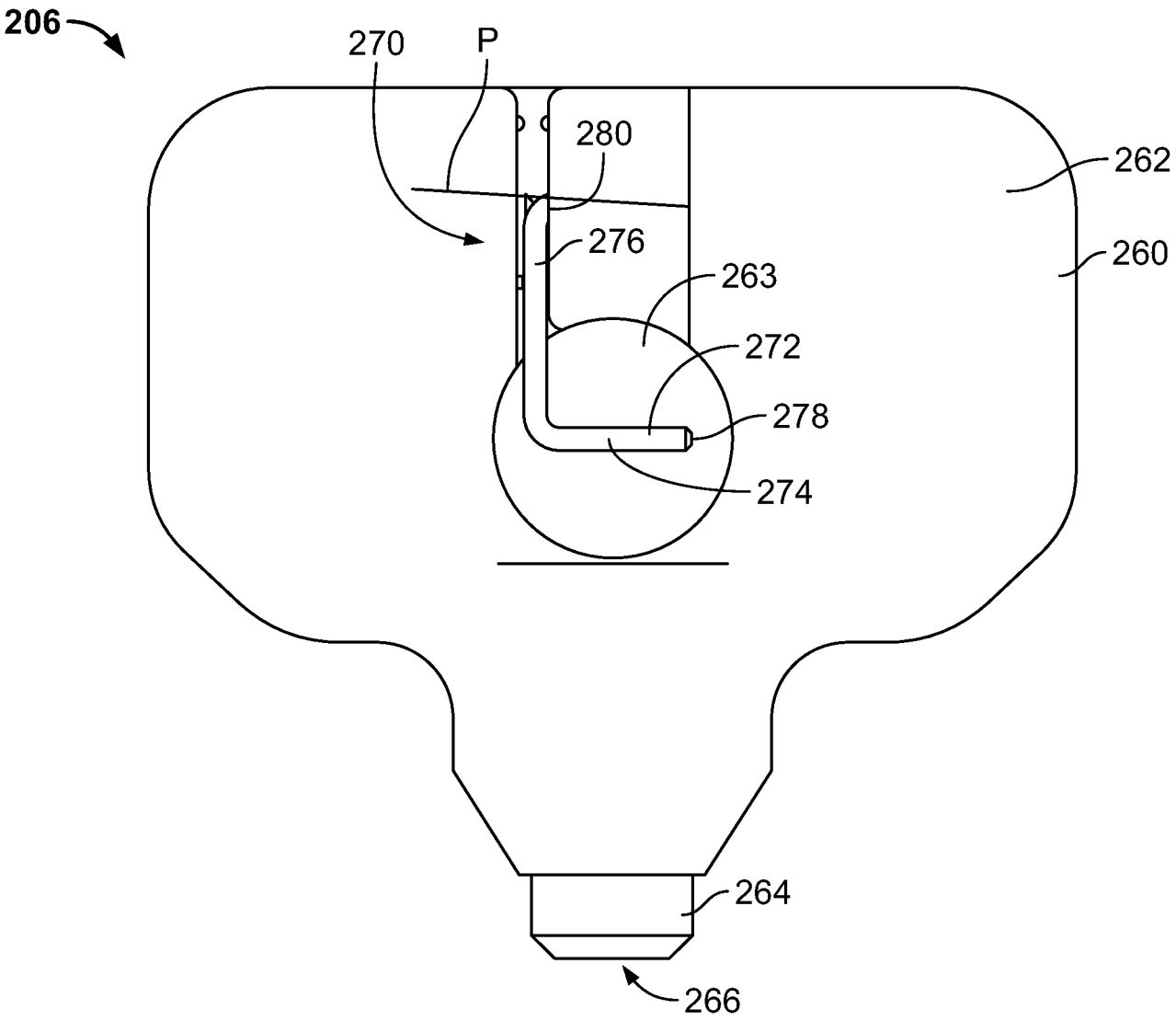
FIG. 6 is a front elevational view of a key designed for use with the spikes of FIGS. 5A and 5B.

FIG. 6 depicts the key 206 designed to be used with the spikes 204 and a shoe 202.

The key 206 includes a body 260 having a handle portion 262 and one or more keyed sections. The handle portion 262 may be contoured to be comfortably grasped by a user. The body 260 may further include a circular opening 263 extending through a central portion of the body 260.

A first key 264 may be provided at an end of the body 260 that includes a racetrack shaped opening 266 designed to interact with spikes that are known in the prior art (see FIG. 1). A second key 270 may be provided that includes an elongate key member 272 that is shaped to correspond to and fit into the hole 250 of the spikes 204. For example, if the hole 250 of the spikes 204 is circular, the key member 272 may be provided as a cylindrical member. The key member 272 is preferably sized such that the key member 272 can extend through the hole 250 of the spikes 204.

As best shown in FIG. 6, the key member 272 is provided as a substantially L-shaped body having a first section 274 and a second section 276. The first section 274 protrudes outwardly at a substantially right angle as compared to the second section 276. A tip 278 of the first section 274 is provided in a shape that is matched to the hole 250 in the spike 204. In some instances, the entire profile of the key member 272 may be provided in a uniform cross-section. In other embodiments, the tip 278 of the first section 274 is provided and matches the hole 250 in the spikes 204, irrespective of the cross-sectional profile of the rest of the key member 272.

The second section 276 extends from the first section 274 and terminates at an attachment point 280. The attachment point 280 is enclosed on the inside of the key member 272 and is designed to rotatably hold the key member 272 in a rest (non-use) position as depicted in FIG. 6 and an in-use position (not shown). To use the key member 272, a user can extend their fingers into the opening 263 to grasp the first section 274 of the key member 272 and rotate the key member 272 upwardly along a pivot axis P formed by the attachment point 280.

Although the spikes 204 and key 206 are depicted being used with a specific shoe 202, it is contemplated that the spikes 204 and/or key 206 could be used with any shoe having the appropriate cylindrical openings (or other attachment mechanism) in the soles thereof.

In use, each of the spikes 204 may be positioned adjacent to their respective bores 218 on the sole 216 of a shoe 202 such that the thread 232 of the spikes 204 contacts the threaded surface of the bore 218. Optionally, a user may at least partially attach the spike 204 onto the shoe 202 by manually rotating the spike 204 to engage the threads. A user may grasp the handle portion 262 of the key 206 such that the opening 266 of the first key 264 is positioned adjacent to, and is contacting the upper surface of the disc member 234 of the spike 204. In this configuration, the spike body 236 of the spike 204 will be positioned within the interior of the first key 264 and surrounded by the racetrack shaped opening 266. Once the key 206 is in position, the user may rotate the key 264 in a clockwise manner until the thread 232 of the spike 204 is completely engaged with the thread of the bore 218. This process may be repeated until all spikes 204 are installed on the shoe 202.

To disengage one or more spikes 204 from the shoe 202, a user grasps the key 206 adjacent the opening 263 and grasps the first section 274 of the second key 270. The second key 270 is then rotated about the attachment point P such that the first section 274 of the second key 270 protrudes upwardly from, and extends beyond, a top surface of the key 206. Once the second key 270 is in position, the user can align the tip 278 of the first section 274 of the second key 270 with the hole 250 in the spike body 236. Once positioned, the user can insert the tip 278 and a portion of the first section 274 of the second key 270 into and through the hole 250, and rotate the second key 270 in a counter-clockwise manner until the thread 232 of the spike 204 is completely disengaged with the thread of the bore 218. In this way, the second key 270 engages with the hole 250 in the spike body 236 and allows for removal of the spike 204 without stripping the spike 204. This process may be repeated until all spikes 204 are uninstalled on the shoe 202. Further, although discussed with respect to removal of the spikes 204 from the shoe 202, the second key 270 may be utilized to install the spikes 203 onto the shoe 202 in the manner discussed above, but rotating the second key 270 in a clockwise manner.

Figure 7:
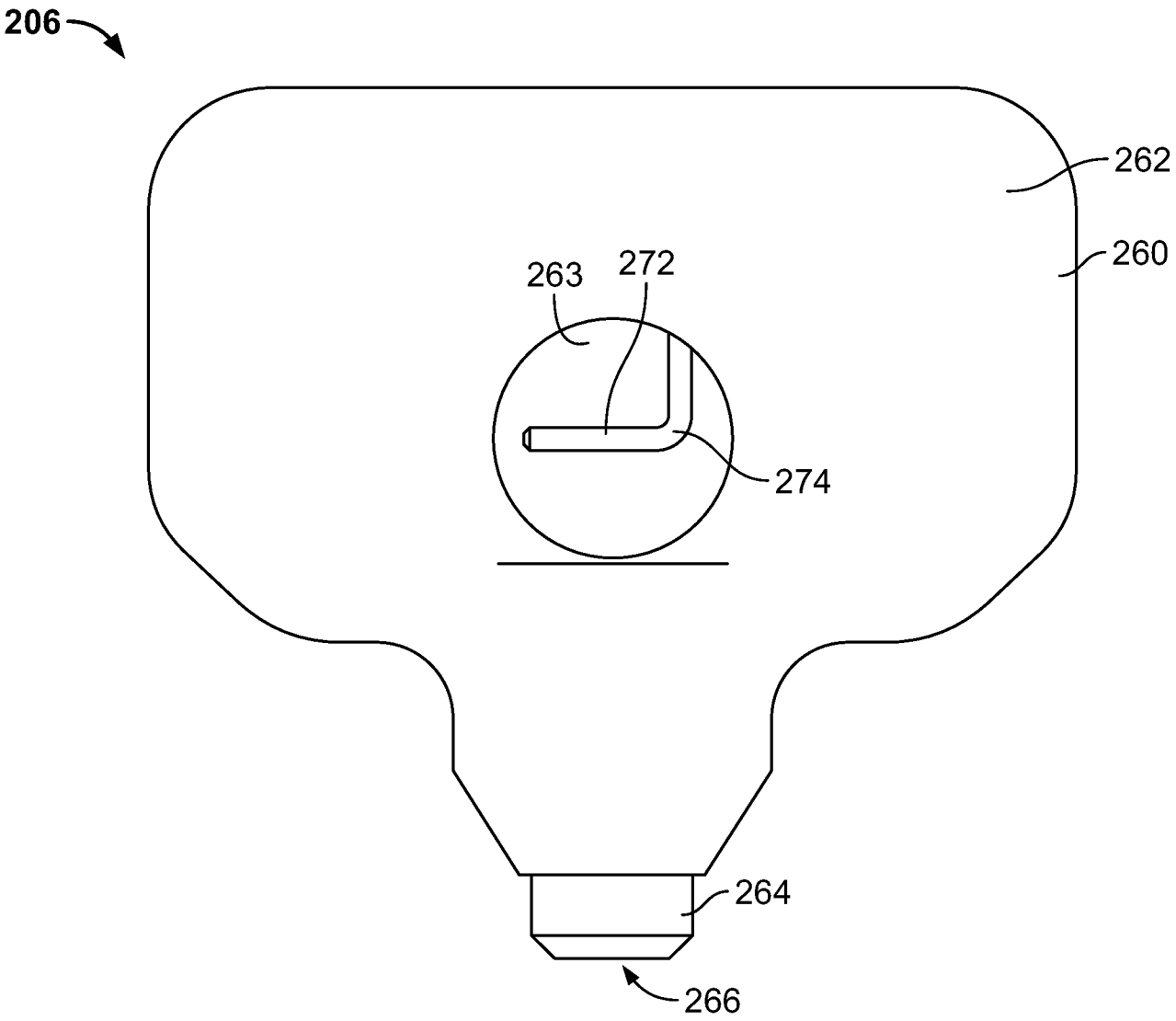
FIG. 7 is a rear elevational view of a key designed for use with the spikes of FIGS. 5A and 5B.
Figure 8:
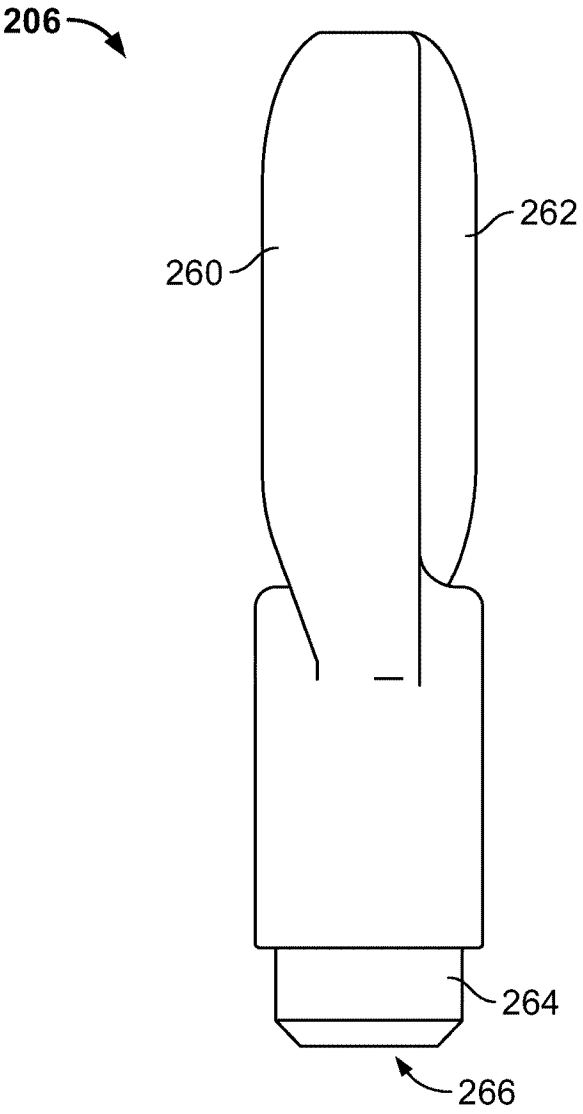
FIG. 8 is a side elevational view of a key designed for use with the spikes of FIGS. 5A and 5B.
Figure 9:
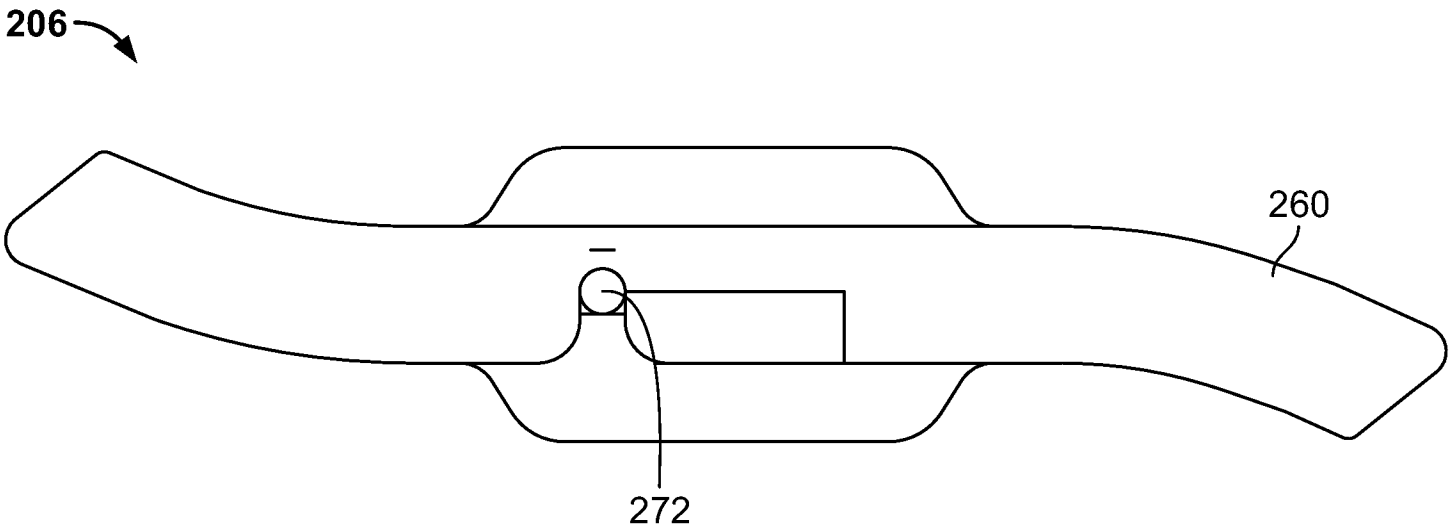
FIG. 9 is a top view of a key designed for use with the spikes of FIGS. 5A and 5B.

This attachment and removal process may be repeated until all spikes 204 are installed/uninstalled on the shoe 202. Further, once the user is finished, the second key 270 is then rotated about the attachment point P again such that the first section 274 of the second key 270 is returned to the non-use position depicted in FIGS. 6 and 7. It should be apparent that one advantage of the key 206 is the inclusion of both the first key 264 and the second key 270 that may be utilized in the appropriate situation. In other instances, a key 206 may be provided that only includes the second key 270. In a further instance, the second key 270 may be provided as an attachment that is designed to be releasably attached to a key 110 known in the prior art. In this version, the second key 270 may include a pin or other mechanism that allows for releasable attachment between the second key 270 and prior art key 110.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

I claim:

1. A spike and key system, comprising:

a spike having a conical tip with a hole extending therethrough; and a key including a first key having an opening and a second key having a key member designed to interact with the hole in the spike;

wherein the key member is provided as a substantially L-shaped body having a first section and a second section, the first section protruding outwardly at a substantially right angle as compared to the second section, and wherein the second section of the key member extends from the first section and terminates at an attachment point, the attachment point being enclosed on the inside of the key member and being designed to rotatably hold the key member in a first configuration, and a second, different configuration.

2. The spike and key system of claim 1, wherein the hole is cylindrical and extends entirely through the spike.

3. The spike and key system of claim 1, wherein the shape of the hole of the spike is substantially the same as the cross-sectional profile of the key member of the second key portion.

4. The spike and key system of claim 1, wherein the spike includes a cylindrical base having threads that circumscribe an exterior surface of the base.

5. The spike and key system of claim 1, wherein the key includes a handle portion designed to be grasped by a user and the first key and the second key.

6. The spike and key system of claim 1, wherein the first section of the key member includes a tip that is provided in a shape that is matched to the hole in the spike.

7. The spike and key system of claim 1, wherein the first configuration is a non-use position and the second configuration is an in-use position.

* * * * *